US010864394B2

(12) United States Patent
Gomaa et al.

(10) Patent No.: US 10,864,394 B2
(45) Date of Patent: Dec. 15, 2020

(54) BALANCING STRIP COLLECTOR FOR RETRACTABLE CURTAIN

(71) Applicants: Ashraf Gomaa, Stony Brook, NY (US); Andrew C. Lambridis, Dix Hills, NY (US); Oscar Escobar, Glendale, NY (US)

(72) Inventors: Ashraf Gomaa, Stony Brook, NY (US); Andrew C. Lambridis, Dix Hills, NY (US); Oscar Escobar, Glendale, NY (US)

(73) Assignee: McKeon Rolling Steel Door Company, Inc., Bellport, NY (US)

( * ) Notice: Subject to any disclaimer, the term of this patent is extended or adjusted under 35 U.S.C. 154(b) by 442 days.

(21) Appl. No.: 15/798,069

(22) Filed: Oct. 30, 2017

(65) Prior Publication Data

US 2018/0117375 A1 May 3, 2018

Related U.S. Application Data

(60) Provisional application No. 62/415,164, filed on Oct. 31, 2016.

(51) Int. Cl.
*E06B 9/42* (2006.01)
*A62C 2/10* (2006.01)
(Continued)

(52) U.S. Cl.
CPC ..... *A62C 2/10* (2013.01); *E06B 3/80* (2013.01); *E06B 5/162* (2013.01); *E06B 9/17* (2013.01);
(Continued)

(58) Field of Classification Search
CPC ..... A62C 2/10; E06B 9/11; E06B 9/08; E06B 9/171; E06B 9/40; E06B 9/42; E06B 9/44;
(Continued)

(56) References Cited

U.S. PATENT DOCUMENTS 846,709 A * 3/1907 Webster ..... E06B 9/50 160/294
2,581,083 A * 1/1952 Drury ..... G09B 29/06 40/517
(Continued)

FOREIGN PATENT DOCUMENTS

KR 20100135365 12/2010
KR 201000135365 * 12/2010 ..... E06B 5/20

OTHER PUBLICATIONS

Search Report dated Apr. 24, 2018 issued in the corresponding Great Britain Patent Application No. 1717963.1.

*Primary Examiner* — Johnnie A. Shablack
(74) *Attorney, Agent, or Firm* — Cozen O'Connor

(57) ABSTRACT

A door assembly includes: a rotatable curtain deployment member positionable about a structure opening; a curtain panel fixed to the curtain deployment member, the curtain being movable, upon rotation of the curtain deployment member, between a retracted position and an extended position, the curtain panel having at least one portion of increased thickness; a rotatable balancing strip member configured to substantially parallel with the curtain deployment member, and configured to rotate synchronously therewith in a common rotational direction, and a balancing strip having a first end attached to the balancing strip member, and a second end attached to the curtain deployment member and axially spaced from the portion of increased thickness. When the curtain panel deploys to the retracted position, the balancing strip deploys to the curtain deployment member, and when the curtain panel deploys to the extended position, the balancing strip deploys to the balancing strip member.

14 Claims, 16 Drawing Sheets

(51) Int. Cl.

| | |
|---|---|
| ***E06B 3/80*** | (2006.01) |
| ***E06B 5/16*** | (2006.01) |
| ***E06B 9/17*** | (2006.01) |
| ***E06B 9/68*** | (2006.01) |
| *E06B 5/02* | (2006.01) |

(52) U.S. Cl.
CPC ..... *E06B 9/42* (2013.01); *E06B 9/68* (2013.01); *E06B 5/025* (2013.01)

(58) Field of Classification Search
CPC ..... E06B 9/68; E06B 9/56; E06B 9/13; E06B 2009/583; E06B 2009/1716; E06B 5/162; E06B 5/025; E06B 3/80; Y10S 160/10
See application file for complete search history.

(56) References Cited

U.S. PATENT DOCUMENTS 3,099,397 A * 7/1963 Abbott ..... F21V 9/40 362/278
3,186,473 A * 6/1965 Myers ..... E06B 9/24 160/26
3,460,602 A * 8/1969 Hugus ..... E06B 9/171 160/265
3,583,465 A * 6/1971 Youngs ..... A47G 5/02 160/264
4,237,956 A * 12/1980 Sivin ..... E06B 9/40 160/120
4,436,137 A * 3/1984 Charles ..... E06B 3/285 160/242
4,610,292 A * 9/1986 Hausmann ..... E06B 9/24 160/120
4,718,471 A * 1/1988 Kraeutler ..... E06B 9/0692 160/84.02
4,727,919 A * 3/1988 Kraeutler ..... E06B 9/0692 160/84.02
4,828,003 A * 5/1989 Kraeutler ..... E06B 9/70 160/84.02
4,896,714 A * 1/1990 Ellis ..... E06B 9/08 160/264
4,934,437 A * 6/1990 Kraeutler ..... E06B 9/60 160/84.02
5,072,767 A * 12/1991 Kraeutler ..... E06B 9/063 160/348
5,632,317 A * 5/1997 Krupke ..... E06B 9/13 160/264
5,682,937 A * 11/1997 Decrane ..... E06B 9/13 160/133
5,706,876 A * 1/1998 Lysyj ..... E06B 9/262 160/84.05
5,819,835 A * 10/1998 Broome ..... A47G 5/02 160/243
5,862,851 A * 1/1999 Stoebich ..... A62C 2/10 160/120
6,019,156 A * 2/2000 Wagner ..... E06B 9/13 160/190
6,070,640 A * 6/2000 Miyagawa ..... A62C 2/10 160/121.1
6,152,207 A * 11/2000 Varley ..... E06B 9/13 160/264
6,192,960 B1 * 2/2001 Simon ..... E06B 9/0653 160/84.06
6,257,305 B1 * 7/2001 Mullet ..... E06B 9/42 160/133
6,962,188 B2 * 11/2005 Coenraets ..... A62C 2/10 160/180
7,490,654 B2 * 2/2009 Gomaa ..... E06B 9/11 160/116
8,800,632 B2 * 8/2014 Cooper ..... A62C 2/10 160/120
8,857,498 B2 * 10/2014 Dondlinger ..... E06B 9/13 160/264
8,925,617 B2 * 1/2015 Miller ..... E06B 9/581 160/133
9,347,258 B2 * 5/2016 Dwarka ..... E06B 9/24
9,358,861 B2 * 6/2016 Rockelmann ..... B60J 1/2041
9,440,100 B2 9/2016 Lambridis
2002/0059985 A1 * 5/2002 Stoebich ..... A62C 2/10 160/41
2009/0008039 A1 1/2009 Lambridis
2009/0266498 A1 * 10/2009 Cooper ..... E06B 9/13 160/309
2015/0300084 A1 * 10/2015 Schonerwald ..... E06B 9/15 160/133
2016/0375283 A1 * 12/2016 Lambridis ..... A62C 2/10 160/121.1
2018/0117375 A1 * 5/2018 Gomaa ..... A62C 2/10

* cited by examiner

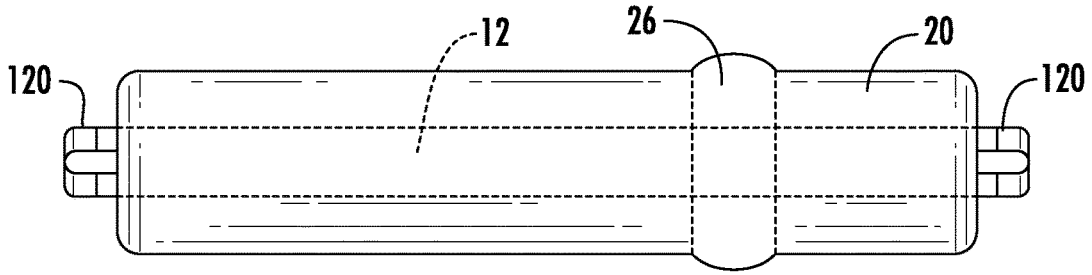
FIG. 11A1
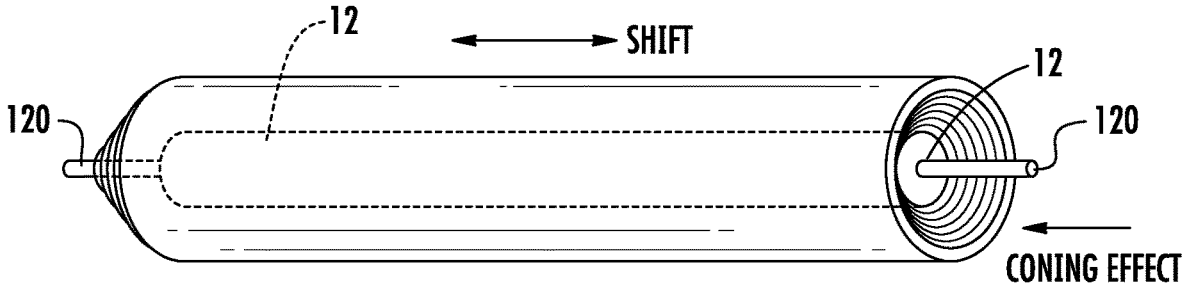
FIG. 11A2

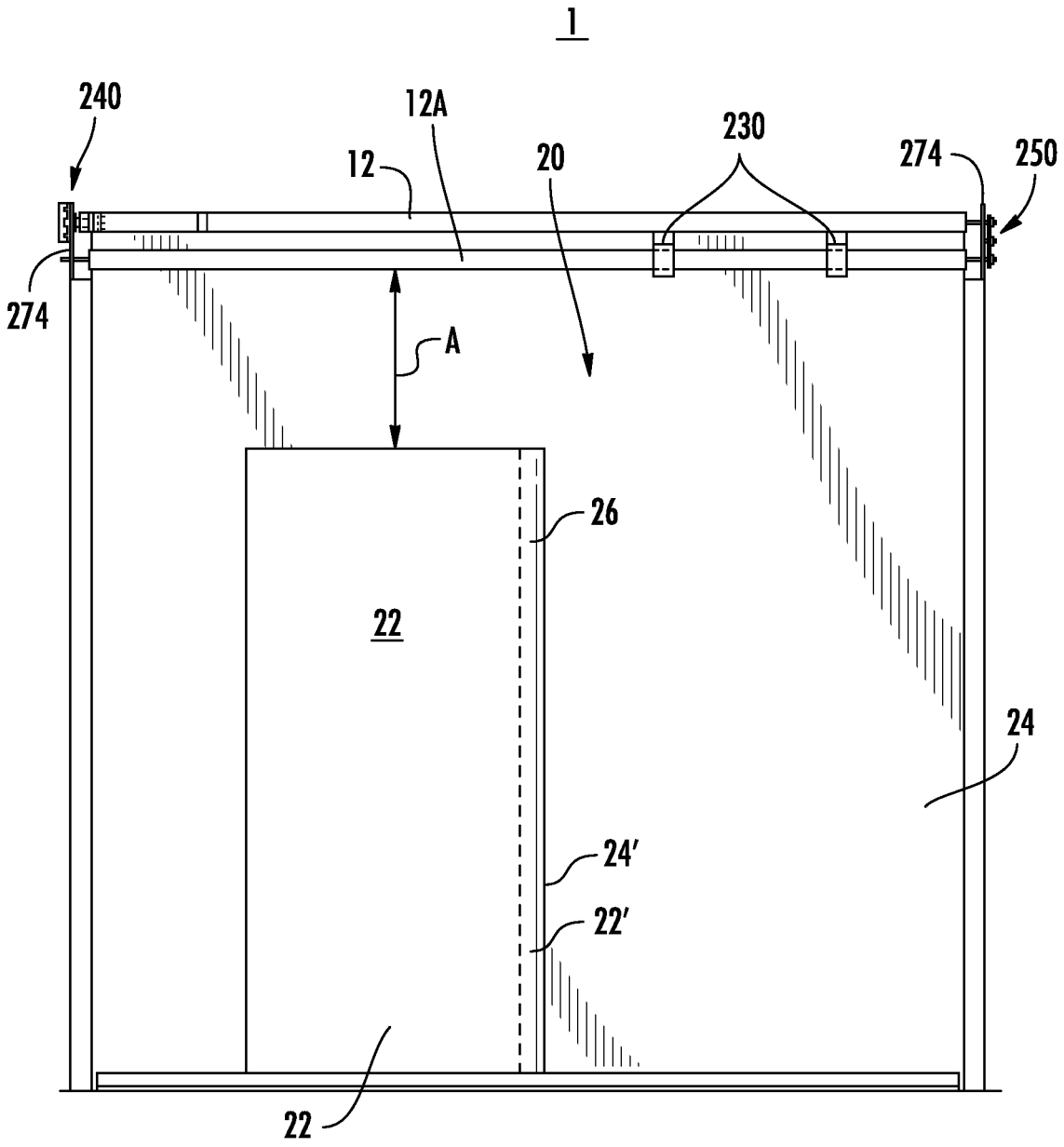
FIG. 12A1

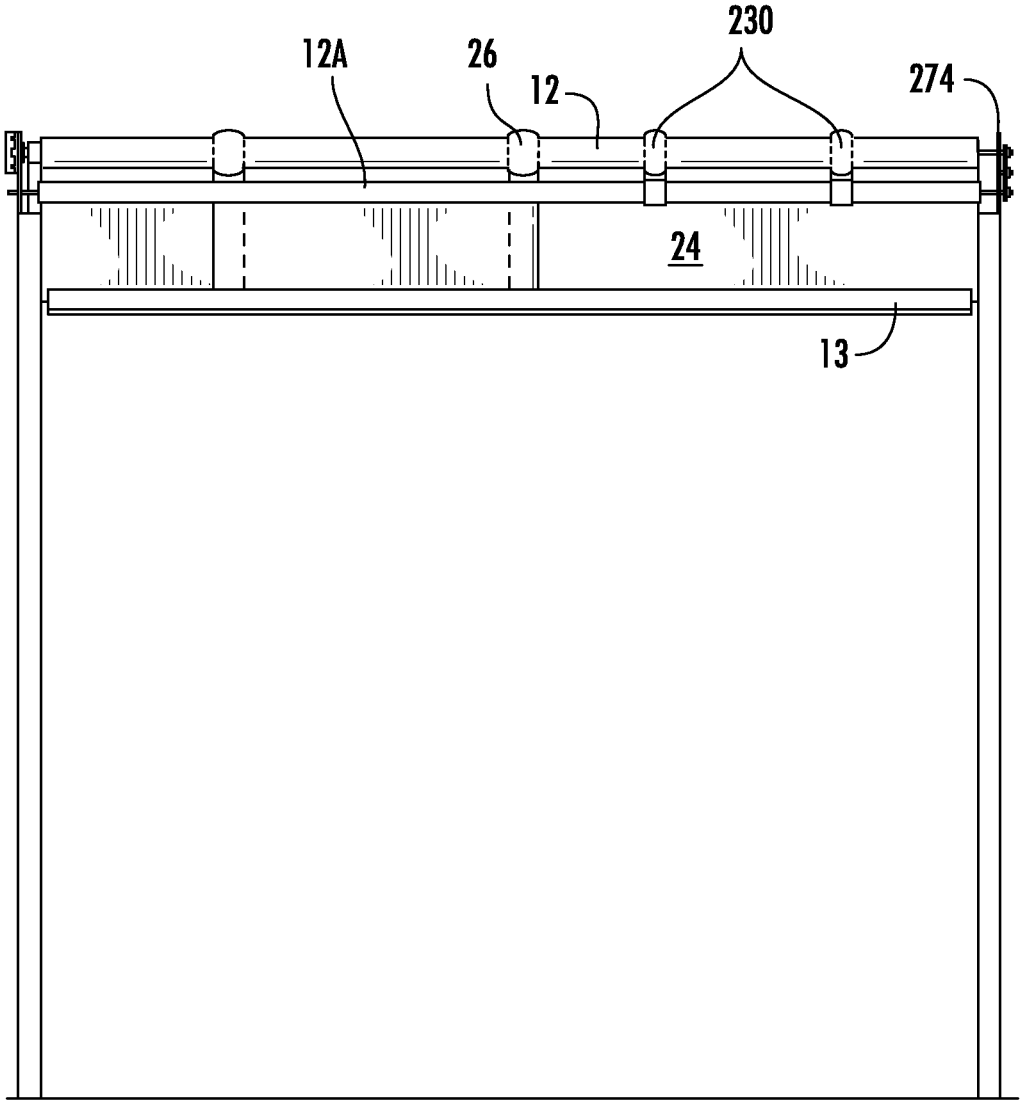
FIG. 12A2

BALANCING STRIP COLLECTOR FOR RETRACTABLE CURTAIN

CROSS-REFERENCE TO RELATED APPLICATION

This application claims benefit under 35 U.S.C. 119(e) of U.S. Provisional application No. 62/415,164, filed Oct. 31, 2016, the entirety of which is incorporated by reference herein.

BACKGROUND OF THE INVENTION

1. Field of the Invention

The present invention relates generally to devices and methods for level rolling up of a curtain and/or smoke blocking device having an egress passage and to devices and methods for improving the profile of the rolled up curtain to compensate for areas of the curtain of differing thickness.

2. Description of the Related Art

A "labeled" door assembly is defined by the National Fire Protection Association as a combination of a door, hardware and other accessories which together provide a specific degree of protection to an opening when closed and to which has been attached a label or other identifying mark to indicate compliance with nationally recognized standards or tests. Conversely, all other door assemblies are referred to as "non-labeled" door assemblies.

For emergency egress purposes, various building codes and the like require any building having either a slide-type or rolling type door assembly to include both a fire door positionable to close an opening and a hinged-type wicket or pass door for passage therethrough when the opening is closed by the fire door.

Rolling door assemblies, which include a shutter curtain that is raised or lowered from a roller positioned above the opening, have been developed.

U.S. Pat. No. 9,440,100 discloses a fire and/or smoke blocking device, such as a fire door assembly, for covering a structure opening in a sidewall of a structure. The fire door assembly comprises a roller assembly to be mounted to a portion of the structure defining the structure opening. The fire door assembly may have a curtain panel disposed on the roller assembly and operable between a retracted position where the curtain panel is wound onto the roller assembly and an extended position where the curtain panel is unwound from the roller assembly to cover the structure opening.

The curtain panel disclosed in U.S. Pat. No. 9,440,100 includes first and second panel portions with mutually opposite edge portions that are releasably connectable in a closed position. A fastener is provided and operable to releasably secure the first and second panel portions to each other in a blocking condition. The first and second panel portions are separable from each other in response to an egress force exerted thereon, thereby forming an egress through the curtain panel. Upon relaxation or removal of the egress force, the first and second panel portions return to the closed position to close the egress. The mutually opposite edge portions at least partially overlap in a preferred embodiment.

U.S. Pat. No. 9,440,100 also discloses a fire door assembly having a roller assembly to be mounted to a portion of the structure defining a portion of the structure opening and a movable flap disposed onto the roller assembly. The movable flap is operable between a retracted position where the movable flap is wound onto the roller assembly and an extended position where the movable flap is unwound from the roller assembly to cover at least a portion of the structure opening. In this fire door assembly, a first fastener is provided to be immovably mounted in relation to the structure in the extended position while a second fastener is fixed to the movable flap to releasably attach to the first fastener, thereby maintaining a blocking condition of the fire door assembly. The first and second fasteners can be selectively disengaged from each other in response to an egress force so that the moving flap can be separated from and moved away from the first fastener to form an egress therebetween. Upon relaxation or removal of the egress force, the movable flap is operable to return to the closed position to close the egress.

FIGS. 1 to 4 show a fire door assembly 1 formed according to a first embodiment of U.S. Pat. No. 9,440,100 in which the fire door assembly 1 is shown and described in connection with a structure opening 3 in a lateral wall of a structure 5, and can be used in connection with structure openings otherwise oriented. In FIG. 1, the fire door assembly 1 is shown in an extended position for covering a structure opening 3 in a sidewall of the structure 5. The fire door assembly 1 comprises a retracting assembly 10 including a roller assembly 12 rotatably mounted to a structure 5 by various known methods. For example, the roller assembly 12 can be horizontally arranged and mounted to a structure portion positioned proximate the upper end of a structure opening 3.

Wrapped about the roller assembly 12 is a curtain panel 20, which can be any suitable rolling door configuration possessing the desired characteristics of flexibility, durability, and fireproof. In U.S. Pat. No. 9,440,100, the curtain panel 20 can be made to be flexible and of a suitable textile material, textile composite material, or metallic material. When the flexible curtain panel 20 is in its extended position as shown in FIG. 1, a fire barrier is established across the structure opening 3. Emergency egress or ingress is formed in the curtain panel 20 as will be described in greater detail below.

The roll-type door structure of U.S. Pat. No. 9,440,100 achieves minimal space requirements and out-of-the way placement above a structure opening 3 when in a retracted position. When not needed, the flexible curtain panel 20 may be wound onto the roller assembly 12 and maintained in a retracted position. The flexible curtain panel 20 may also be unwound into the extended position shown in FIG. 1.

The curtain panel 20 of U.S. Pat. No. 9,440,100 can comprise first and second panel portions 22, 24. In the example shown in FIG. 1, the first panel portion 22 is arranged in a center portion along the transverse width of the curtain panel 20. The second panel portion 24 is arranged on one side of the first panel portion 22. The first and second panel portions 22, 24 can have mutually opposite edge portions 22', 24' that are releasably connectable to form a blocking condition, as is shown in FIG. 1, where the fire door assembly 1 acts as a barrier to prevent fire and/or smoke from spreading from one side of the fire door assembly 1 to the other side. For example, the opposite edge portions 22', 24' can connect to each other in an end-to-end fashion. In the examples shown in FIGS. 2 to 4, the first panel portion 22 can at least partially overlap with the second panel portion 22 to form an overlapping region 26.

As FIG. 2 shows, the overlapping region 26 has an elongated shape extending throughout the entire length of the curtain panel 20.

U.S. Pat. No. 9,440,100 also discloses that a third panel portion 28 can also be provided on an opposite side edge of the first panel portion 22 and separated from the second panel portion 24 by the first panel portion 22. The third panel portion 28 can be similarly formed to the second panel portion 24 and at least partially overlap with the first panel portion 22 to form another overlapping region 26, as further illustrated in FIGS. 3 and 4. All the first, second, and third panel portions 22, 24, 28 can be wound onto the roller assembly 12 when the fire door assembly 1 is in the retracted position or unwound from the roller assembly 12 to form a fully extended curtain panel 22 at the extended position.

As is illustrated in FIGS. 2 to 4 of U.S. Pat. No. 9,440,100, a fastener 30 is provided on and fixed to each of the panel portions 22, 24, 28 to releasably connect the panel portions 22, 24, 28 to each other forming a blocking condition. For example, a fastener 30 is fixed to each of the mutually opposite edge portions 22', 24' of the first and second panel portions 22, 24 by various known methods. As FIGS. 2 to 4 show, the fastener 30 can be positioned in the overlapping regions 26. In one example, the fastener 30 is formed to have an elongated shape, similar to that of the overlapping region 26 and fixed to the overlapping edge portions 22', 24' of the first and second panel portions 22, 24 so that the first and second panel portions 22, 24 are continuously fastened from the top to the bottom of the edge portions 22', 24'.

U.S. Pat. No. 9,440,100 discloses that fastener 30 is designed so that it can repeatedly alternate between an engaged condition and a disengaged condition, to thereby releasably attach the panel portions 22, 24 and/or 22, 28. For example, the fastener 30 attaches the overlapping first and second panel portions 22, 24 to each other in an engaged condition and form a blocking condition. When an egress force F is exerted on the first panel portion 22 in an egress direction, the fastener 30 is disengaged so that the first and second panel portions 22, 24 can be separated from each other to form an egress E through the curtain panel 20. Upon relaxation or removal of the egress force F, the first and second panel portions 22, 24 can return to the closed position, as is shown in FIG. 1, and be rejoined to each other by the fastener 30 to close the egress E. U.S. Pat. No. 9,440,100 also discloses that the mutually opposite edge portions 22', 24' of the first and second panel portions 22, 24 can overlap with or abut each other to cover the structure opening 3.

U.S. Pat. No. 9,440,100 also discloses that the fire door assembly 1 can also include first and second side frames 40, which are to be mounted to the structure 5. The side frames 40 each define a recess 42 (FIG. 3) therein for receiving and guiding a corresponding side edge of the curtain panel 20. Such side frames 40, according to U.S. Pat. No. 9,440,100, can provide additional stability for the flexible curtain panel 20 as the curtain panel 20 is moved between its retracted position and extended position. Additionally or alternatively, the side frames 40 can hold the side edge of the curtain panel 20 in position when the curtain panel 20 is in the extended position.

In an example shown in FIG. 1 of U.S. Pat. No. 9,440,100, a closure device 50 is provided and formed on the curtain panel 20 along a curtain edge opposite to the roller assembly 12, e.g., the bottom edge of the curtain panel 20. In one example, the closure device 50 is operable to conform to the condition of the structure surface that the closure device 50 is disposed on when the fire door assembly 1 is in an extended position. For example, the conforming device 50 can be in the form of a flexible pocket 52 formed along the bottom edge of the first panel portion 22 and contain a conformable material in the pocket 52. Additionally or alternatively, an additional closure device 50 can be similarly formed on the second and/or third panel portions 24, 28 of the curtain panel 20.

U.S. Pat. No. 9,440,100 discloses that the pocket 52 can be formed from the same material piece used to form the corresponding panel portions 22, 24, 28, such as by folding over an end portion of the material piece and affix the free end to the overlapping material piece. It is also disclosed that pocket 52 can also be separately formed, with or without the conformable material, and then fixed to the panel portions 22, 24, 28. The conformable material can be any material that has a sufficient mass and can freely move or flow when not being restricted. Preferably, the conformable material is a material with a higher density than the curtain panel material. For example, sand or water can be used in the pocket 52 as a conformable material.

Because of the mobility and heavier weight of the conformable material inside the pocket 52, the closure device 50 is operable to conform to any irregularity on the floor surface of the structure 5, thereby fully covering and/or sealing the structure opening 3 when the curtain panel 20 is in the extended position. Additionally or alternatively, the closure device 50 can operate to assist the first panel portion 22 to return to the closed position due to the added weight at the bottom of the first panel portion 22.

In additional examples shown in FIGS. 5 and 6, U.S. Pat. No. 9,440,100 discloses that the closure device 50 can be in the form of metal rails 52*a*, 52*b* fixed to the bottom edges of the first and second panel portions 22, 24. According to U.S. Pat. No. 9,440,100, the metal rails 52*a*, 52*b* can be formed so that they conform to the floor surface when the fire door assembly 1 is in the extended position. For example, the metal rails 52*a*, 52*b* are formed so that they are flat at the bottom to conform to a flat floor surface.

Optionally, according to U.S. Pat. No. 9,440,100, the metal rails 52*a*, 52*b* can be formed with one or more interlocking portions 54*a*, 54*b* to facilitate in retaining the first panel portion 22 in the closed position. For example, the interlocking portions 54*a*, 54*b* can be formed as male and female interlocking portions. Once the interlocking portions 54*a*, 54*b* are engaged with each other, they can operate to prevent the first panel portion 22 from moving in a vertical direction in relation to the second panel portion 24. The interlocking portions 54*a*, 54*b* are formed on the egress side of the fire door assembly 1, allowing the first panel portion 22 to be deflected in response to an egress force F (FIG. 6) and, when the first panel portion 22 returns to the closed position, preventing the first panel portion 22 from moving away from the closed position.

U.S. Pat. No. 9,440,100 discloses that additionally or alternatively, the metal rails 52*a*, 52*b* can be formed with one or more guiding portions 56*a*, 56*b* to facilitate the first panel portion 22 in returning to the closed position. The guiding portions 56*a*, 56*b* can be formed as slanted ends of the metal rails 52*a*, 52*b* opposing to each other in a closed position. Upon relaxation or removal of the egress force F, the guiding portions 56*a*, 56*b* can aid the first panel portion 22 to return to the closed position.

U.S. Pat. No. 9,440,100 also discloses that, as is shown in FIGS. 5 and 6, the fire door assembly 1 can have a bottom frame 60 provided and configured to be mounted to the structure 5. The bottom frame 60 can cooperate with the closure device 50 and facilitate retention of the same in position when the fire door assembly 1 is in the extended position when used in an emergency situation. The bottom frame 60, for example, comprises a first curtain stop 62 for restricting the first panel portion 22 from moving away from a closed position when returning to such closed position (FIG. 1) from the egress condition (FIG. 2). In one example, the first curtain stop 62 is in the form of a rib raised from a supporting plate 64 on the egress side, as is shown in FIG. 6. In this example, the supporting plate 64 can be substantially flat to conform to the metal rails 52*a*, 52*b*.

According to U.S. Pat. No. 9,440,100, additionally or alternatively, the bottom frame 60 can comprise a second curtain stop 66 for restricting the second panel portion 24 from lateral movement in relation to the structure. In the examples shown in FIGS. 5 and 6, the second curtain stop 66 is in the form of a pair of ribs raised from the supporting plate 64 and spaced from each other for retaining at least a portion the closure device 50, such as the metal rail 52*b*, therein.

In operation, the fire door assembly 1 of U.S. Pat. No. 9,440,100 is installed in a structure opening 3 and maintained in a retracted position. During an emergency, the fire door assembly 1 will turn into the extended position in a known manner, whereby the panel portions 22, 24, 28 will unwind from the roller assembly 12 and become extended as are shown in FIG. 1. The closure devices 50 formed at the bottom edges of the panel portions 22, 24, 28 can assist the panel portions to become fully extended to cover the structure opening 3 to prevent fire or smoke from spreading from one side of the curtain panel 20 to the other side thereof. The closure devices 40 can also fit into the bottom frame 60 to be maintained in the blocking condition in the event of pressure change due the fire and/or smoke condition.

When egress is needed, the user may pull or push the first panel portion 22 to disengage the fastener 30 from its engaged position and move away from the blocking position to form an egress through the curtain panel 20. Once the user passes through the egress to the safe side, the user can simply release the first panel portion 22. The first panel portion 22 will return to its blocking position under the action of gravity from the mass of the first panel portion 22, as well as the closure device 50 attached to the bottom of the first panel portion 22 if such closure device 50 is employed. When the first panel portion 22 returns to its blocking position and overlaps with the second panel portion 24, the fastener 30 operates to reengage and secure the first and second panel portions 22, 24 to each other so as to retain the blocking condition and prevent fire and smoke from spreading through the egress.

FIG. 7 of U.S. Pat. No. 9,440,100 shows a fire door assembly 1*a* formed according to a second embodiment, which is similar to the fire door assembly 1 shown in FIGS. 1 to 4. In this embodiment, only one first panel portion 22 and one second panel portion 24 are provided forming a single overlap region 26, and in turn one egress for passing through the curtain panel 20. The single egress structure shown in FIG. 7 can be beneficial in returning the first panel portion 22 to the overlapping condition, after being deflected therefrom to form the egress, so as to be re-secured to the second panel portion 24 through the fastener 30.

U.S. Pat. No. 9,440,100 also discloses an option in which a collapsible handle 70 can be provided on the first panel portion 22. For example, the collapsible handle 70 can be provided on the pulling side of the first panel portion 22 to assist in separating the first panel portion 22 from the second panel portion 24 when forming the egress. In FIG. 7, the first panel portion 22 is shown to be pulled toward the reader when the first panel portion 22 is detached from the second portion 24 to form the egress. The handle 70 can assist the user in operating the fire door assembly 1*a*. The 70 handle can be formed in a collapsible manner so that it can be wound onto the roller assembly 12 along with the curtain panel 20.

FIG. 8 of U.S. Pat. No. 9,440,100 shows a fire door assembly 1*b* formed according to a third embodiment, in which the overlapping regions 26 extend along only a portion of the entire length of the curtain panel 20. In particular, the top portion of the curtain panel 20 is free of the overlapping regions 26.

FIG. 9 of U.S. Pat. No. 9,440,100 shows a fire door assembly 1*c* formed according to a fourth embodiment, which is similarly formed to the fire door assembly 1*b* described above. In this embodiment, the overlapping regions 26 are formed in a middle section of the curtain length without extending into the top portion and the bottom portion of the curtain panel 20. As FIG. 9 shows, a reinforcement panel 29 is provided and attached to the bottom portion of the curtain panel 20. The closing panel 29 can operate to retain the first panel portion 22 in the closing condition and/or assist in returning the deflected first panel portion 22 to the overlapping condition.

FIG. 10 of U.S. Pat. No. 9,440,100 shows a fire door assembly 1*d* formed according to a fifth embodiment. In this embodiment, the fire door assembly 1*d* comprises a movable flap 22*a*, which can be similarly formed as the first panel portion 22 and operably wound onto the roller assembly 12. In FIG. 10, a portion of the movable flap 22*a* is lifted open to show a first fastener 30*a* fixed to the right side edge of the movable flap 22*a*. The first fastener 30*a* is formed to engage a second fastener 30*b*, which is immovably mounted in relation to the structure 5. For example, FIG. 10 shows that the second fastener 30*b* is directly mounted on the sidewall of the structure 5. Such a second fastener 30*b* is supported to offset the roller assembly 12 so as to allow the movable flap 22*a* to unwind to its extended position without obstruction and to come in contact with the second fastener 30*b* to be attached thereto.

Alternatively, the second fastener 30*b* can be provided on a side panel portion, similar to the second panel portion 24 shown in FIGS. 1-4 or otherwise mounted to the structure 5. The first and second fasteners 30*a*, 30*b* are formed similarly to the fastener 30 described above.

When the movable flap 22*a* is unwound from the roller assembly 12 and extended to the extended position, the first and second fasteners 30*a*, 30*b* can releasably attach to each other to secure the movable flap 22*a* to the structure 5 and retain the blocking condition of the fire door assembly 1*d*. Similar to the fastener 30 described above, the first and second fasteners 30*a*, 30*b* in the embodiment can be selectively disengaged from each other in response to an egress force F to separate the moving flap 22*a* from the second fastener 30*b* and form an egress E therebetween. Once the egress force F is released, the movable flap 22*a* returns to the closed position due to the action of gravity. The first and second fasteners 30*a*, 30*b* can reengage with each other to close the egress.

The left side edge of the movable flap 22*a* can be secured to a side frame 40 in a similar manner that the third panel portion 28 is secured to a corresponding side frame 40 shown in FIG. 1. In the alternative, the left side edge of the movable flap 22*a* can be formed similarly to its right side edge and engage with a fastener immovably mounted on the right side in relation to the structure 5. In such a case, either side edge of the movable flap 22*a* can be detached and lifted to form an egress.

Although the fasteners and flaps provided in U.S. Pat. No. 9,440,100 provide an effective egress through a deployed fire curtain, differences in thickness will, of necessity, exist between the main portion of the curtain and the portions of the curtain at the edges of the movable flaps, due to, for example, the additional thickness of the overlapping material at the flap location. These differences in thickness provide for uneven distribution of the curtain on the barrel in the rolled up condition, in which condition elevations and unevennesses may be present in portions corresponding to the overlapping portions.

SUMMARY OF THE INVENTION

In accordance with an aspect of the invention, a balancing strip collector is provided which includes an additional roller (e.g. a rotatable balancing strip member) that, working in conjunction with the curtain coil roller (e.g., a rotatable curtain deployment member), feeds a balancing, i.e., compensating, strip of material onto the curtain coil roller during take up of the curtain. The balancing strip is provided to the curtain coil roller at one or more locations on the roller longitudinally disposed axially away from the overlapping portions corresponding to the edges of the flaps. The use of the balancing strip or strips results in a compensated thickness of the material of the curtain when the curtain is rolled on the curtain coil roller, thereby aligning the curtain on the curtain coil roller.

In accordance with another aspect of the invention, a door assembly is provided which is positionable about a structure opening in a structure wall. The door assembly includes a rotatable curtain deployment member having a longitudinal axis and positionable about the structure opening; a curtain panel having a first end fixed to the curtain deployment member, and a free end. The free end is movable in a movable direction, upon rotation of the curtain deployment member, between a retracted position where the structure opening is at least partially uncovered, and an extended position where the curtain panel covers at least a portion of the structure opening. The curtain panel has at least one portion of increased thickness aligned with a location on the curtain deployment member. The portion of increased thickness extends in the movable direction over at least a portion of the curtain panel. A rotatable balancing strip member is provided which has a longitudinal axis and a length. At least a portion of the length is longitudinally coextensive with the curtain deployment member. The balancing strip member is configured to be mounted about the structure opening in a substantially parallel arrangement with the curtain deployment member. The balancing strip member is engaged with the curtain deployment member so as to rotate synchronously, and in a common rotational direction, with the curtain deployment member. A balancing strip is also provided. The balancing strip has a first end attached to the balancing strip member, and a second end attached to the curtain deployment member, the balancing strip being axially spaced from the portion of increased thickness. Upon synchronous movement of the balancing strip member and curtain deployment member in a direction to deploy the curtain panel into the retracted position, at least a portion of the balancing strip deploys from the balancing strip member to the curtain deployment member, and upon synchronous movement of the balancing strip member and curtain deployment member to deploy the curtain panel to the extended position, the portion of the balancing strip deploys from the curtain deployment member to the balancing strip member.

In another aspect, a thickness of the balancing strip when rolled up on the curtain deployment member is set to correspond to a thickness of the portion of increased thickness of the curtain panel when the curtain panel is rolled up on the curtain deployment member.

In another aspect, the balancing strip ends are positioned at an aligned location on the curtain deployment member and the balancing strip member.

In another aspect, the at least one portion of increased thickness of the curtain panel extends in the movable direction over a portion of the curtain panel less than the entire length of the curtain deployment member in the movable direction, and a thickness of the balancing strip is configured so as to have a thickness that approximates the thickness of the at least one portion of increased thickness of the curtain panel only over a portion of the length of the balancing strip that corresponds with the at least one portion of increased thickness of the curtain deployment member.

In another aspect, the curtain panel is flexible, establishes a fire barrier across the structure opening in the extended position, and includes one from among the group of: a fire resistant textile material, a fire resistant textile composite material, and a fire resistant metallic material.

In another aspect, the at least one portion of increased thickness comprises at least one overlapping portion of the curtain panel.

In another aspect, a location of the balancing strip in the longitudinal direction is at a location that does not longitudinally overlap with the at least one overlapping portion, so that the balancing strip is located longitudinally separated from each at least one overlapping portion so that the curtain panel is evenly suspended over the at least one overlapping portion and the balancing strip.

In another aspect, the door assembly further includes a sprocket and chain, or pulley and belt, connection formed between the balancing strip member and the curtain deployment member, the connection providing synchronization of rotational movement, in a common rotational direction, between the rotatable balancing strip member and the curtain deployment member.

In another aspect, the rotatable balancing strip member includes a constant tensioning spring assembly, the constant tensioning spring assembly being configured to provide a spring bias for the rotatable balancing strip member in a direction opposite a take up direction of the curtain panel and the at least one balancing strip, so as to provide a pull on the balancing strip portion traversing a gap between the rotatable curtain deployment member and the rotatable balancing strip member, the pull preventing the occurrence of slack in the portion of the balancing strip between the rotatable curtain deployment member and the rotatable balancing strip member.

In another aspect, in the extended position of the curtain panel, each at least one balancing strip is completely wound around the rotatable balancing strip member except for a connecting portion of the balancing strip which extends to, and connects with, the rotatable curtain deployment member.

In another aspect, the connection of the connecting portion of the balancing strip to the rotatable curtain deployment member occurs at an affixing location on the rotatable curtain deployment member.

In another aspect, the connection of the connecting portion of the balancing strip to the rotatable curtain deployment member is implemented by one or more of the group of: an adhesive, a connection with a slot formed in the rotatable curtain deployment member, staples, and non-staple fasteners.

In another aspect, the connecting portion of the balancing strip is attached, at the affixing location, at a side of the rotatable curtain deployment member from which the curtain panel hangs, and to which the curtain panel, when being rolled up, will travel such that, when the rotatable curtain deployment member turns so as to retract the curtain panel onto the rotatable curtain deployment member, the same turning of the rotatable curtain deployment member will, for each instance of the balancing strip, cause a taking up initially of the connecting portion of the balancing strip, and subsequently the remainder of the balancing strip, onto the rotatable curtain deployment member.

In another aspect, the door assembly further includes a motor configured to directly drive the rotatable curtain deployment member to wind the curtain panel and the balancing strips onto the rotatable curtain deployment member.

BRIEF DESCRIPTION OF THE DRAWINGS

In the drawings:

FIG. 11A1 shows a view of a curtain for a fire door assembly wound around the curtain coil barrel in the absence of the balancing strip collector, with a wider portion shown in an area of an overlapping region of the curtain material;

FIG. 11A2 shows a coning effect that results from the unevenness caused by the overlapping region;

FIG. 12A1 is an elevation view of the fire door assembly having the balancing strip collector of the present invention;

FIG. 12A2 shows the view of the door assembly of FIG. 12A but with the curtain in a partially rolled up position and the bottom bar 13 positioned substantially parallel to the curtain coil barrel 12;

DETAILED DESCRIPTION OF THE PRESENTLY PREFERRED EMBODIMENTS

Figure 1:
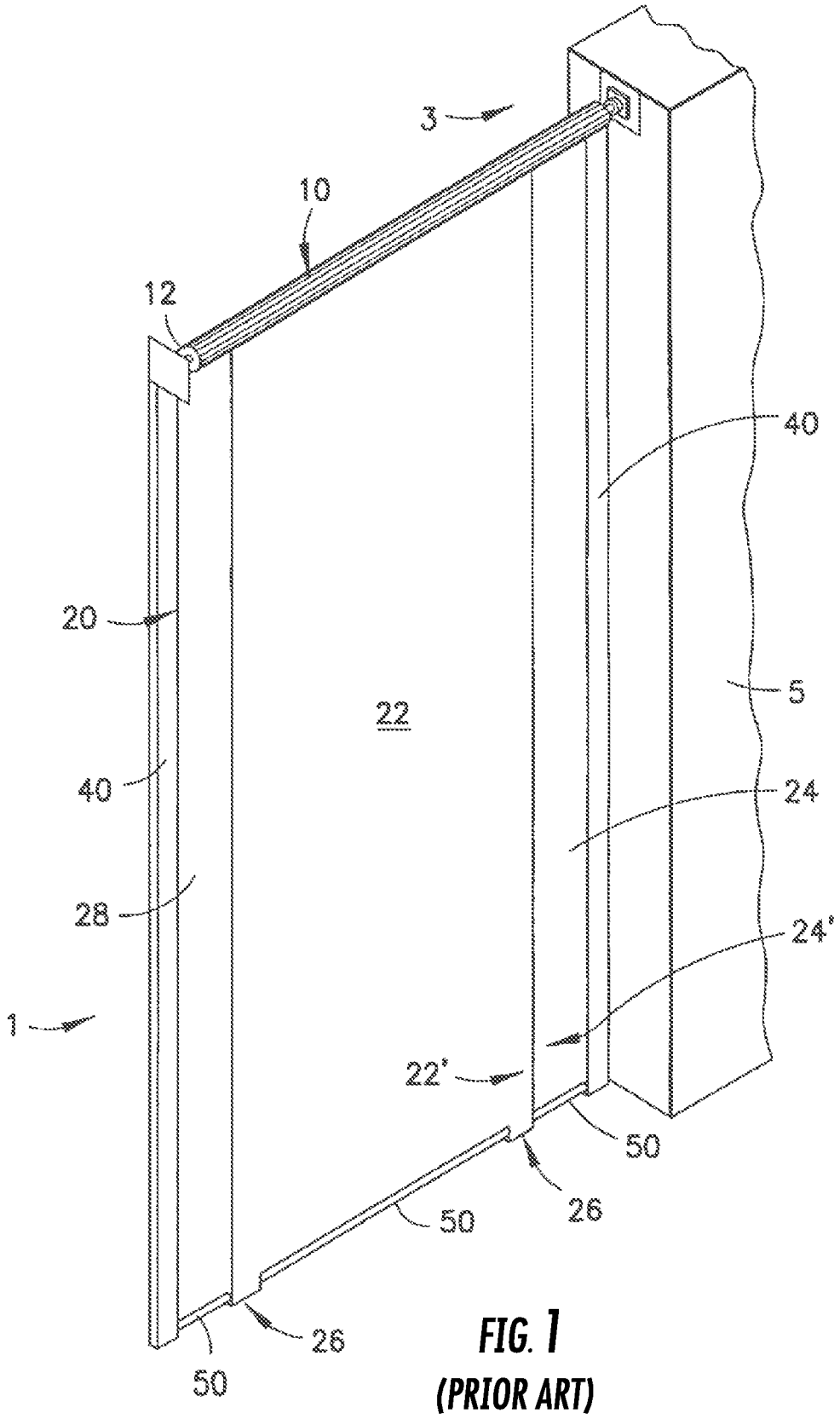
FIG. 1 (PRIOR ART)
FIG. 1 is a perspective view of a known fire curtain or door assembly formed according to an embodiment.

In the description to follow, components performing the same function as in the above-described FIGS. 1-10 will be assigned like reference numerals.

In the various embodiments described below and depicted in the figures, the door assembly having a balancing strip collector of the present invention may be used, for example in a fire and/or smoke blocking device in the form of a fire door or curtain assembly. The fire and/or smoke blocking device in which the balancing strip collector may be used can also be formed as a fire curtain assembly, a smoke door assembly, a smoke curtain assembly, or similar assemblies that are labeled assemblies and can be used in a fire and/or smoke situation to cover a structure opening, so as to prevent fire and/or smoke from spreading to other sections of the structure. While the embodiments disclosed below are illustrated with respect to a fire door or curtain assembly, the inventive balancing strip collector can be used in other contexts in which curtains having regions of uneven thickness are employed.

Figure 2:
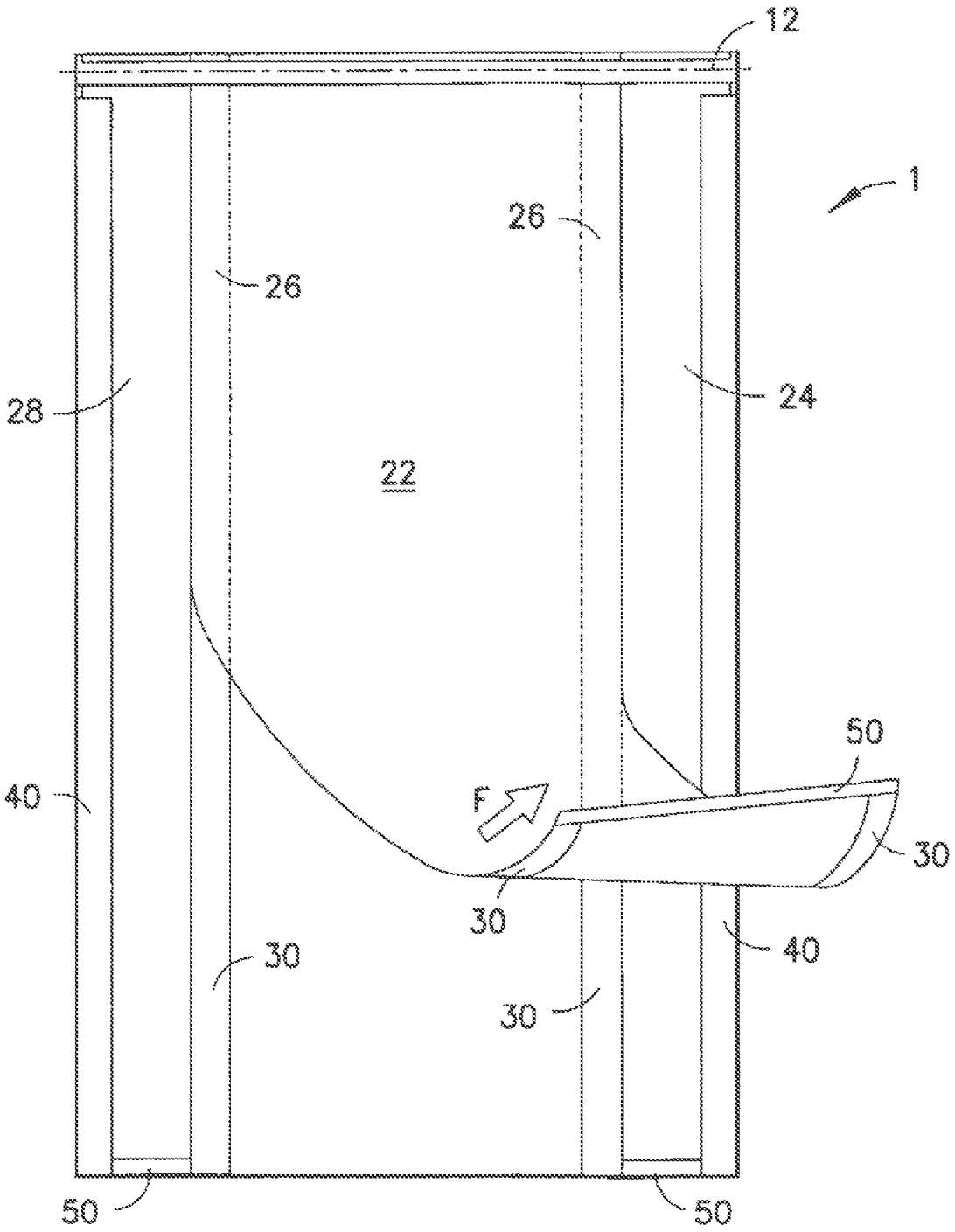
FIG. 2 (PRIOR ART)
FIG. 2 is an elevation view of a known fire door assembly with the center panel partially separated from the side panels to reveal the fasteners.
Figure 3:
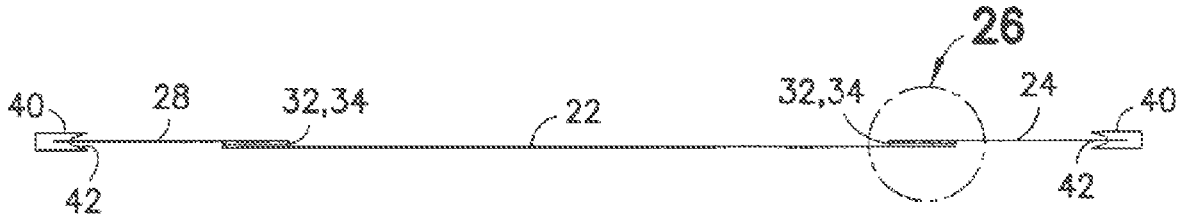
FIG. 3 (PRIOR ART)
FIG. 3 is a top view of the known fire door assembly shown in FIG. 2.
Figure 4:
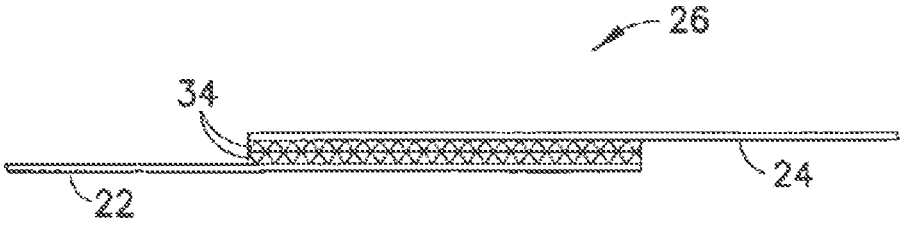
FIG. 4 (PRIOR ART)
FIG. 4 is an enlarged view of portion 26 shown in FIG. 3.
Figure 5:
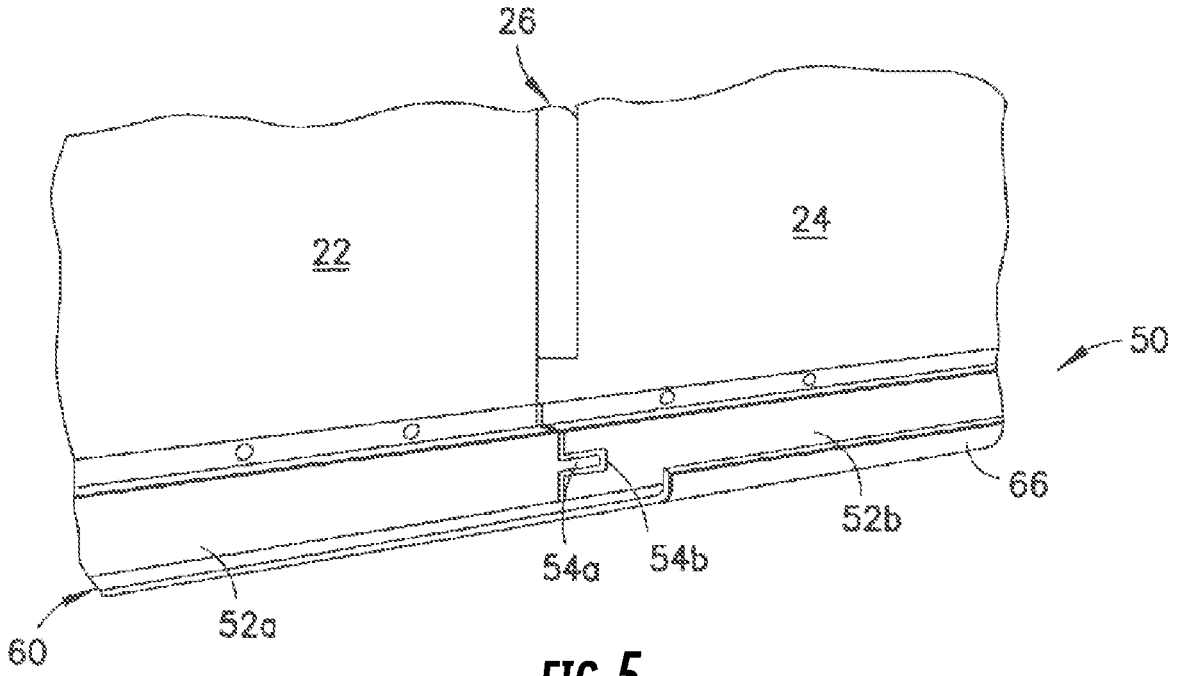
FIG. 5 (PRIOR ART)
FIG. 5 is a partial perspective view from an egress side of a known fire curtain or door assembly showing the closure device when the first panel portion is in a blocking condition.
Figure 6:
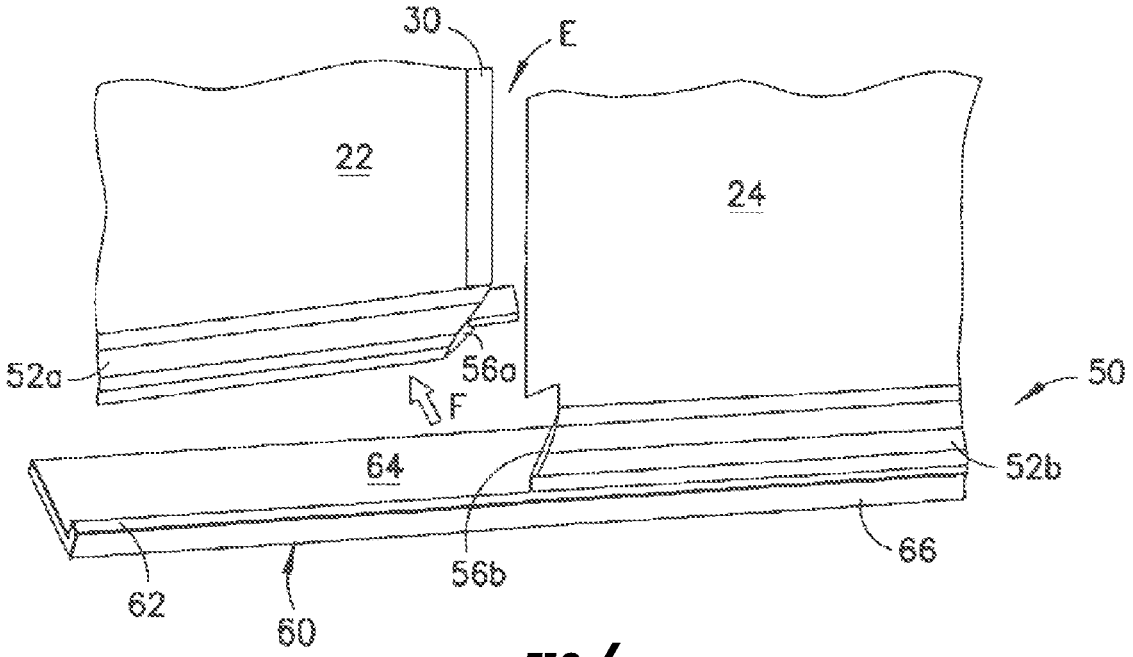
FIG. 6 (PRIOR ART)
FIG. 6 is a partial perspective view of the known fire door assembly of FIG. 5 from the opposite egress side showing the closure device when the first panel portion is in an open position.
Figure 7:
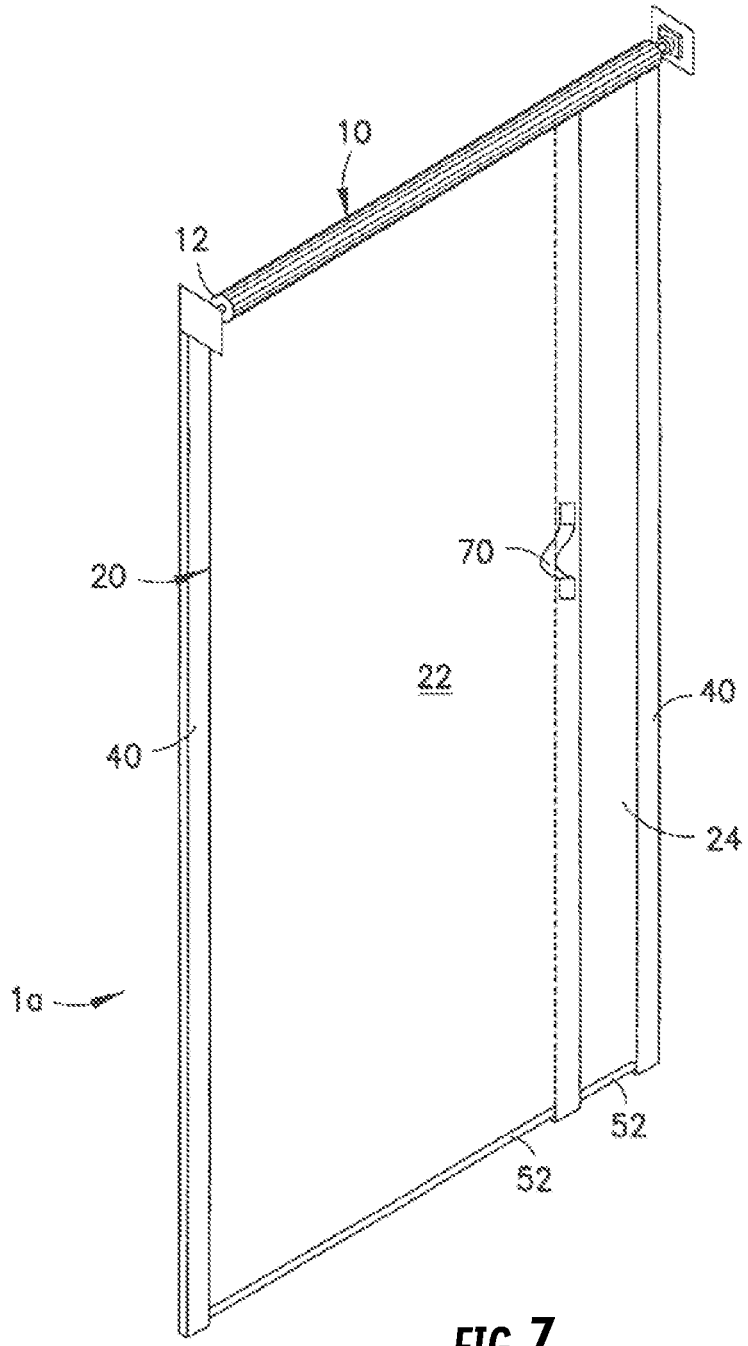
FIG. 7 (PRIOR ART)
FIG. 7 is a perspective view of a known fire door assembly formed according to another embodiment.
Figure 8:
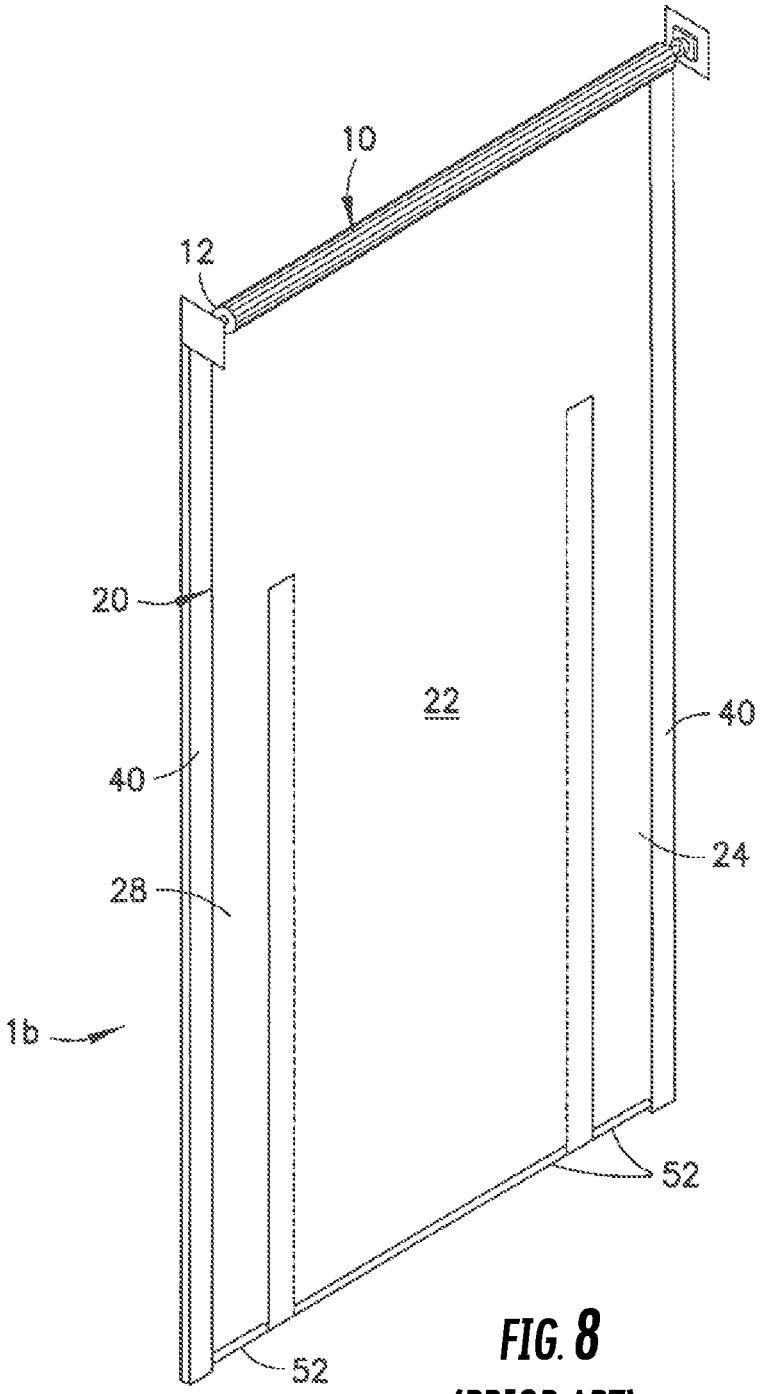
FIG. 8 (PRIOR ART)
FIG. 8 is a perspective view of a known fire door assembly formed according to another embodiment.
Figure 9:
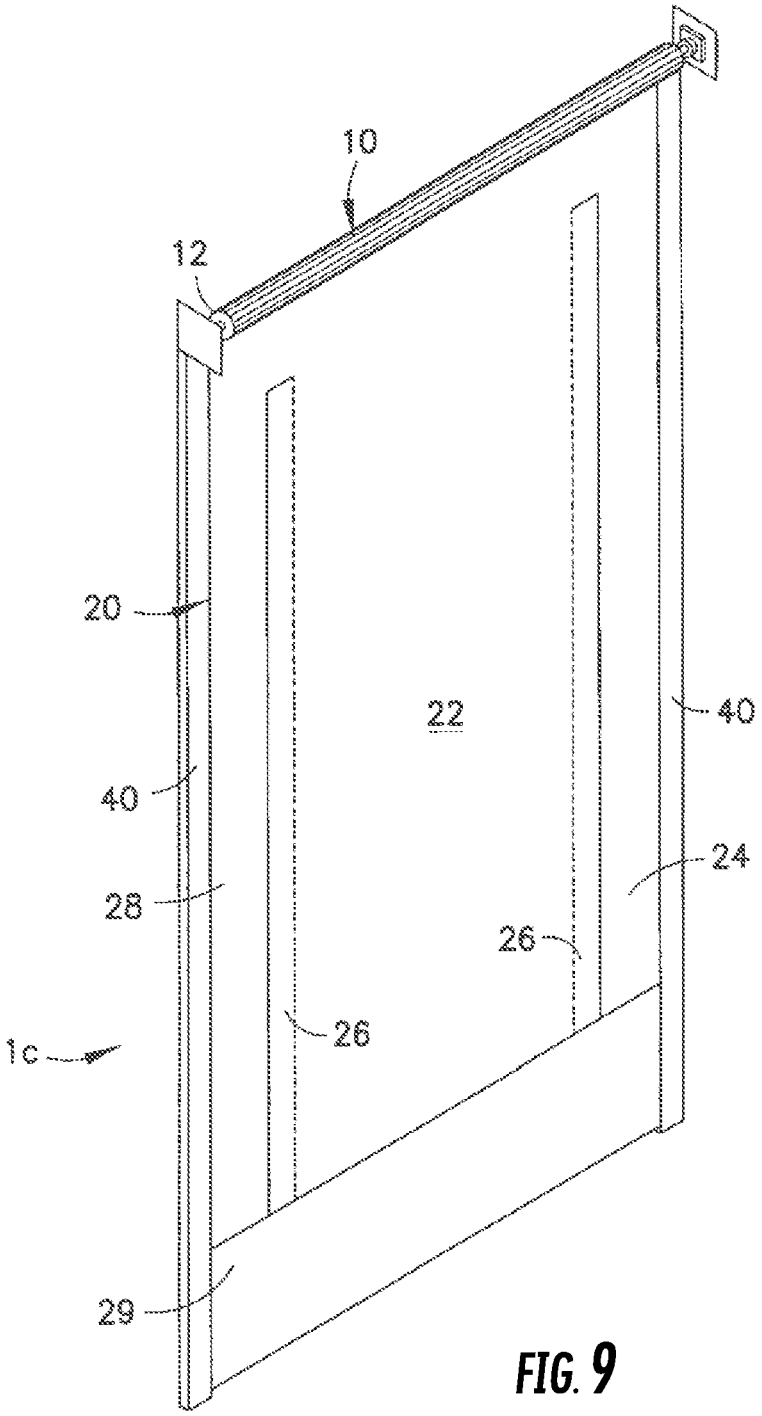
FIG. 9 (PRIOR ART)
FIG. 9 is a perspective view of a known fire door assembly formed according to another embodiment.
Figure 10:
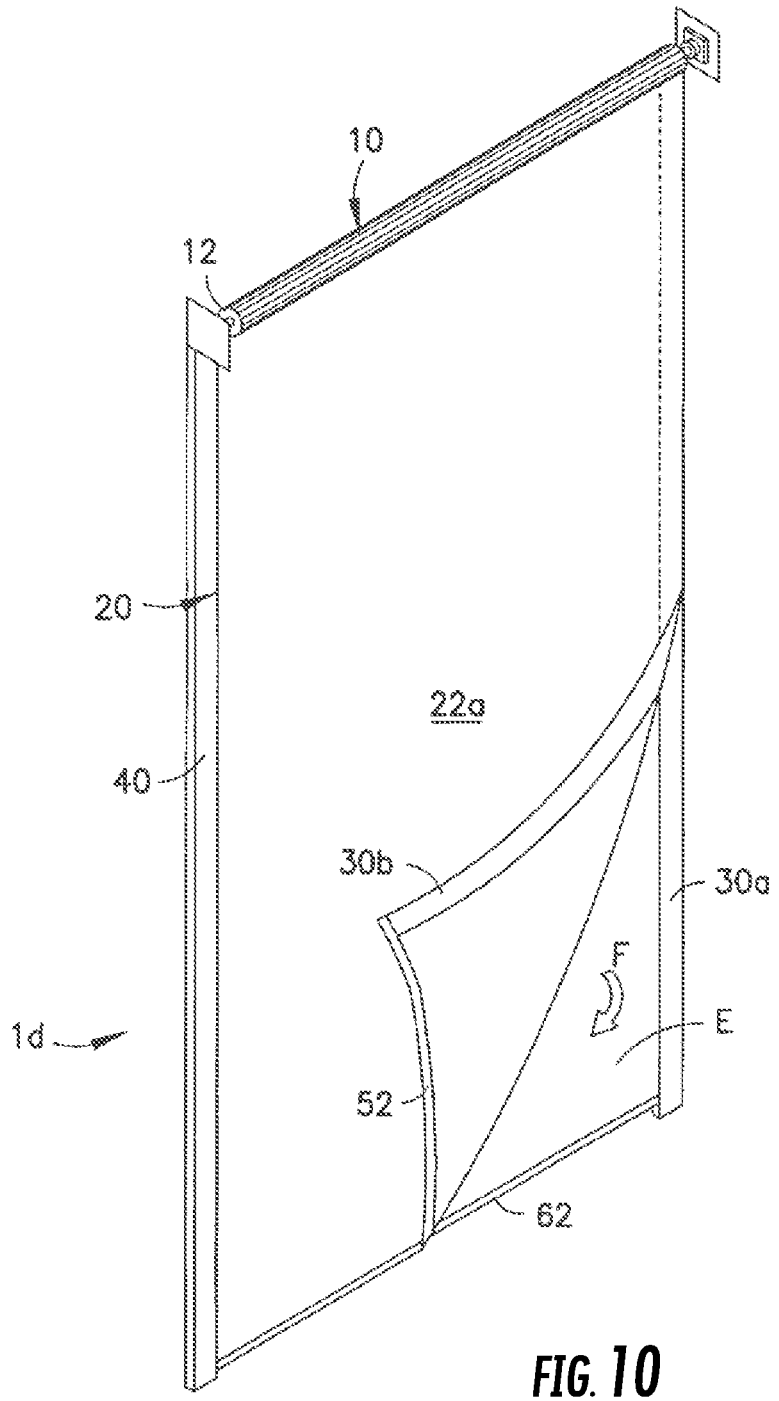
FIG. 10 (PRIOR ART)
FIG. 10 is a perspective view of a known fire door assembly formed according to another embodiment.
Figure 11B:
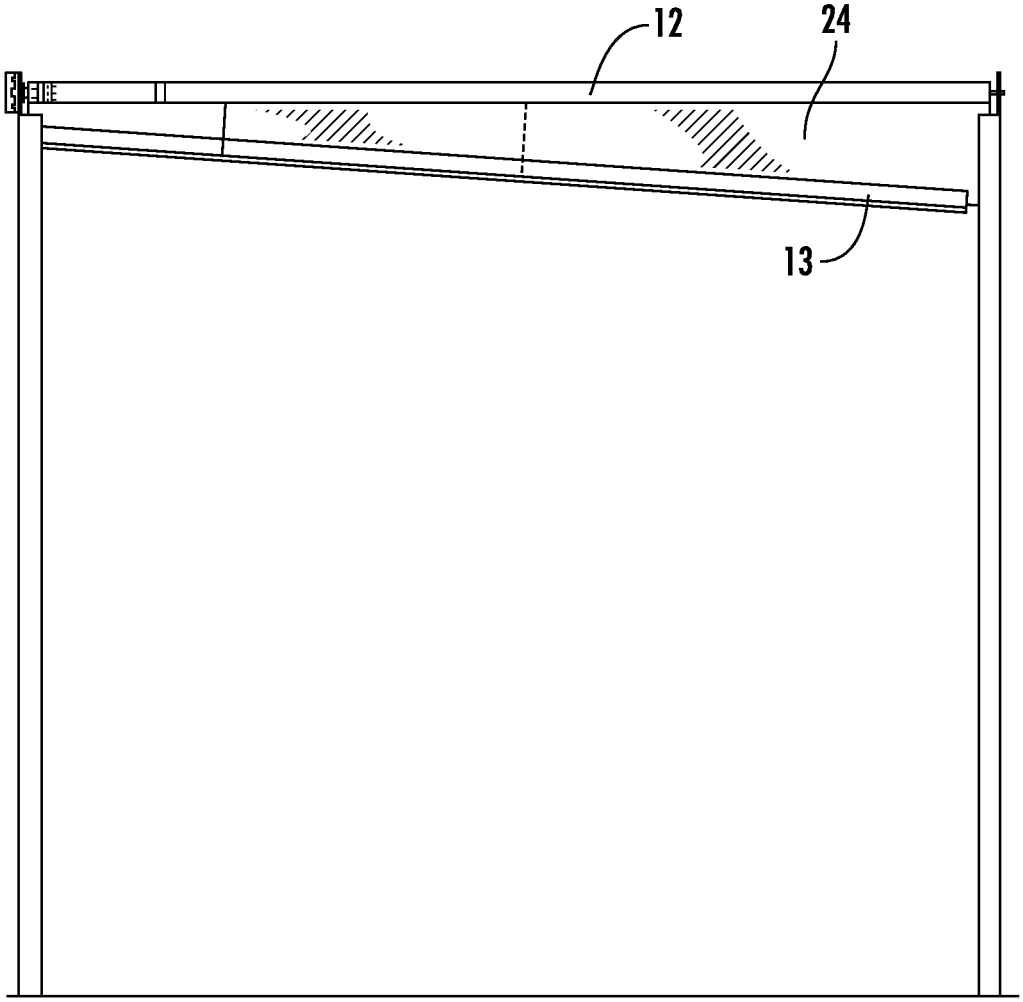
FIG. 11B shows a rolled up curtain without the balancing strips. As shown, a bottom bar 13 attached to a leading edge of the curtain is angled in the opening as a result of the wider overlapping portions of the curtain.

FIG. 11A1 is a view of a curtain (e.g., curtain panel) 20 of the type having an overlapping region 26 such as shown in U.S. Pat. No. 9,440,100 when the curtain is retracted onto, i.e., rolled up on, the curtain coil barrel 12. As can be seen from the view in FIG. 11A1, due to the differences in thickness between the overlapping region 26 and the relatively thinner, non-overlapping portions of the curtain 20, the thickness of the wound up curtain 20 varies over the longitudinal extent of the curtain coil barrel (e.g., rotatable curtain deployment member) 12. In particular, the portion of the curtain at the overlapping region 26, being thicker, i.e., consisting of two layers, causes an uneven longitudinal thickness profile. This is shown in FIG. 11B where in the bottom bar 13 attached to the leading edge of the curtain is angled with respect to the curtain coil barrel 12. FIG. 11A2 illustrates a coning effect that occurs due to the overlapping region 26. In this effect, the unevenness causes the curtain to roll up further and further to one side, due to a shifting force applied during winding of the uneven curtain.

Figure 12B:
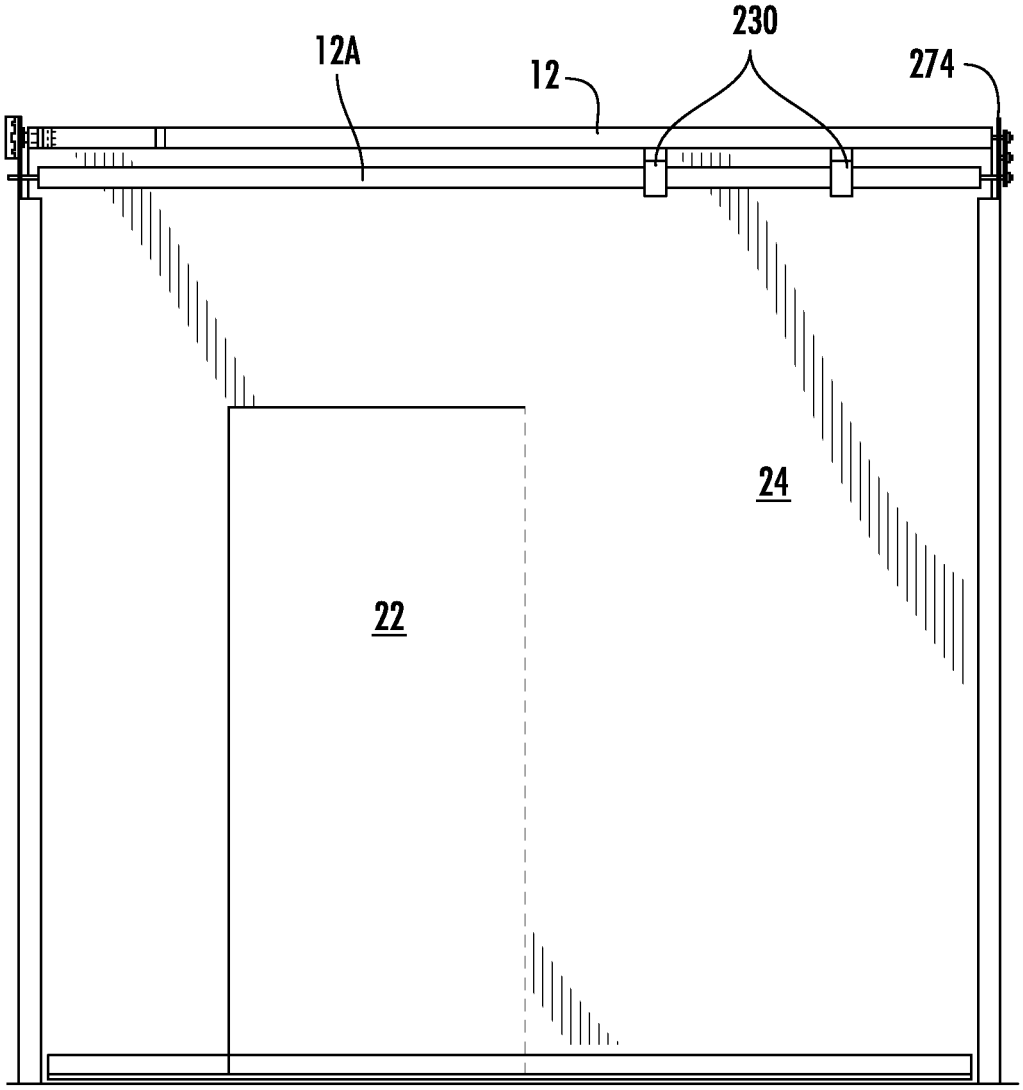
FIG. 12B shows the view of the door assembly of FIG. 12A2 but with the curtain fully deployed.

FIG. 12A1 shows a fire door or curtain assembly similar to the type shown, for example, in FIG. 2, but employing the inventive balancing strip collector apparatus of the present invention. As can be seen from FIG. 12A1, similar to FIG. 2 but with only one region 26, the curtain 20 has a first panel portion 22 arranged in a center portion along the transverse width of the curtain panel 20. A second panel portion 24 is arranged on a side of the first panel 22. The first and second panel portions 22, 24 can have mutually opposite edge portions 22', 24' that are releasably connectable to form a blocking condition, as is shown, for example, in FIG. 1, where the fire door assembly 1 acts as a barrier to prevent fire and/or smoke from spreading from one side of the fire door assembly 1 to the other side. FIGS. 12A2 and 12B show the curtain with the balancing strips in various positions. As shown, the bottom bar remains substantially parallel with the curtain coil barrel 12.

Just as in FIG. 2, the opposite edge portions 22', 24' can connect to each other in an end-to-end fashion. In FIG. 12A1, the first panel portion 22 can at least partially overlap with the second panel portion 22 to form an overlapping region 26.

As discussed above with respect to FIGS. 11A1 and 11A2, the overlapping region 26 that can cause an uneven rolling up of the curtain 20. To compensate for this unevenness, the inventive balancing strip collector apparatus is provided.

The balancing strip collector includes, in addition to the curtain coil barrel 12, a balancing strip collector barrel 12A. The balancing strip collector barrel 12A is arranged parallel to the curtain coil barrel 12 and is engaged with the curtain coil barrel 12, in a manner discussed further below, so as to rotate in the same direction as the curtain coil barrel 12. Each barrel 12, 12A, is supported, at each end, by an endplate 274.

FIGS. 12A1 and 12B show the fire door assembly employing the inventive balancing strip collector apparatus of the present invention in a position in which the curtain 20 is in the deployed, i.e., unwound state. In the unwound, i.e., deployed, state of the curtain 20, each of the balancing strips 230 are completely wound around the balancing strip collector barrel 12A except for a connecting portion 231 which extends to, and connects with, the curtain coil barrel 12. The connection of the connecting portion 231 to the curtain coil barrel 12 occurs at an affixing location 232 on the curtain coil barrel 12, and can be, for example, implemented by adhesive, connection with a slot formed in the curtain core barrel 12, staples or other fasteners, or combinations of these techniques.

Figure 13:
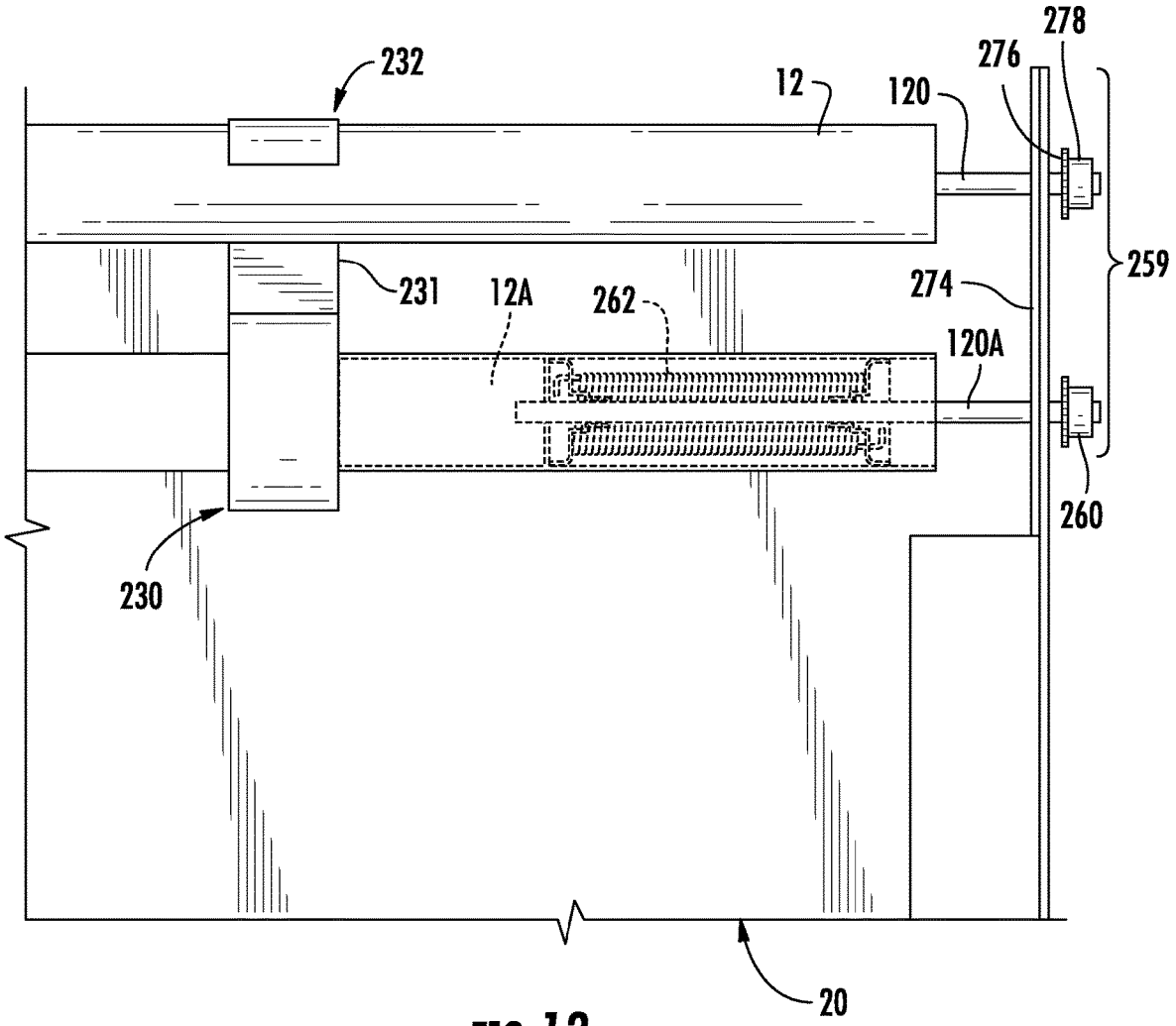
FIG. 13 is a detail of a portion of the fire door assembly with the balancing strip of FIG. 12A1.
Figure 14:
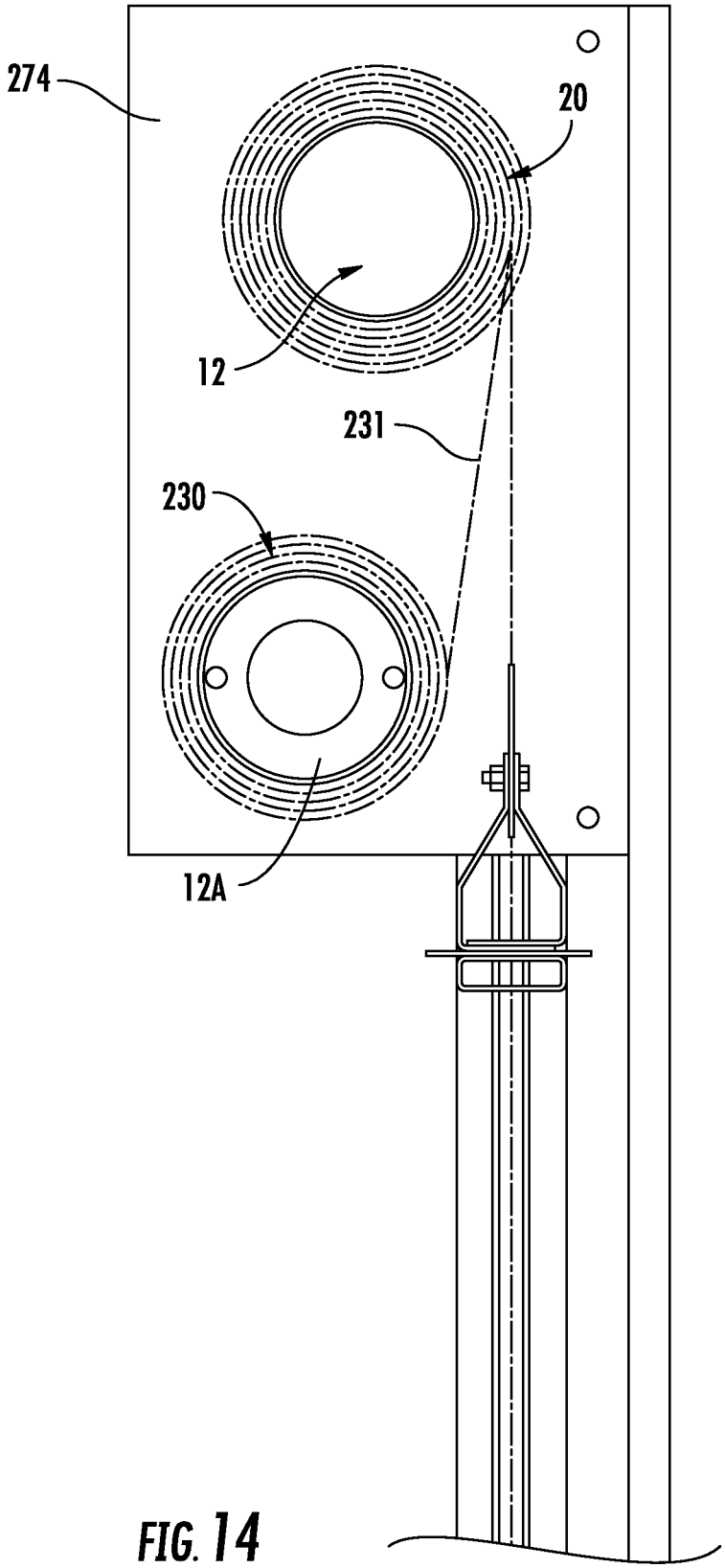
FIG. 14 is a sectional view of the fire door assembly with the balancing strip of FIG. 12A1 when viewed from the side.

As can be seen in FIGS. 13 and 14, the connecting portion 231 is attached, at the affixing location 232, at the back of the curtain coil barrel 12, i.e., the side of the curtain coil barrel 12 from which the curtain 20 hangs, and to which the curtain 20, when being rolled up, will travel. By virtue of this arrangement, when the curtain coil barrel 12 turns so as to retract the curtain 20 onto the curtain coil barrel 12, i.e., when the curtain is lifted out of the doorway, the same turning of the curtain coil barrel 12 will, for each instance of the balancing strip, cause a taking up initially of connecting portion 231 of the balancing strip 230, and subsequently the remainder of the balancing strip 230, onto the curtain coil barrel 12.

In retracting the curtain 20, the curtain 20 is wound up so as to wrap around the curtain coil barrel 12. Due to the arrangement of the balancing strip collector apparatus, the balancing strip 230 will, during this time, also be wound onto the curtain coil barrel 12.

Figure 15:
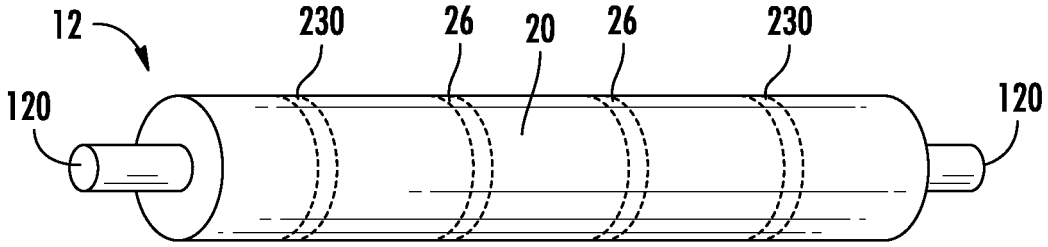
FIG. 15 is a view of a curtain for a fire door assembly wound around the curtain core barrel using the balancing strip collector of the present invention.

The balancing strip 230 is selected so as to have, at appropriate locations along its length, a thickness that substantially corresponds to the additional thickness of the overlapping area or areas 26. In this manner, and with suitable placement of the balancing strip (or strips) on the balancing strip collector barrel 12A, the rolling up of the curtain 20, together with the rolling up of the balancing strip 230, onto the curtain coil barrel 12 will result in a smooth generally cylindrical wound curtain 20, as can be seen, for example, in FIG. 15, which shows a completely retracted curtain in which the uneven-ness that would have been caused by the overlapping area(s) 26 is balanced out by the added thicknesses provided by the winding of the balancing strip 230 on the curtain coil barrel 12 at appropriate locations.

It should be noted that the overlapping portions 26 may not need to extend over the entire height of the curtain 20. This is shown, for example, in FIG. 12A1 in which the overlapping portions 26 are only located below a distance A from the top of the curtain. To account for this, the thickness of the balancing strip 230 is set to be of a minimal (negligible) thickness when rolling up the upper portion (having length A) of the curtain 20. The balancing strip 230 then thickens, to approximate the thickness of the overlapping portion or portions 26, once the curtain is rolled past the length A, i.e., once the overlapping portions 26 reach the curtain coil barrel 12. Thus, the balancing effect of the balancing strip, or strips, will only begin when it is needed, that is, only when the overlapping portions 26 actually begin rolling up on the curtain coil barrel 12.

The locations of the balancing strip(s) 230 in the longitudinal direction should preferably be at locations that do not longitudinally overlap with the overlapping area(s) 26, as doing so would simply having an additive effect on the lumpiness in the rolling up of the curtain. Preferably, the balancing strips 230 should be located longitudinally separated from the overlapping area(s) 26 so that the curtain 20 is evenly suspended over the overlapping area(s) 26 and the wound balancing strips 230. Depending on the arrangement of the overlapping areas 26, one, or two, or perhaps more, balancing strips may be necessary to provide the best balancing effect.

In view of the connection between the balancing strips 230 on the balancing strip collector barrel 12A and the curtain coil barrel 12, the apparatus of the present invention only requires a single motor 241, i.e., a motor that directly drives the curtail coil barrel 12, to wind the curtain 20 and the balancing strips 230 onto the curtain coil barrel 12. However, for unwinding the curtain, it is required that the turning of the balancing strip collector barrel 12A be mechanically synchronized with the turning of the curtain coil barrel 12. This synchronization is provided by a sprocket and chain (or pulley and belt) connection 249 formed between barrels 12 and 12A.

Figure 16:
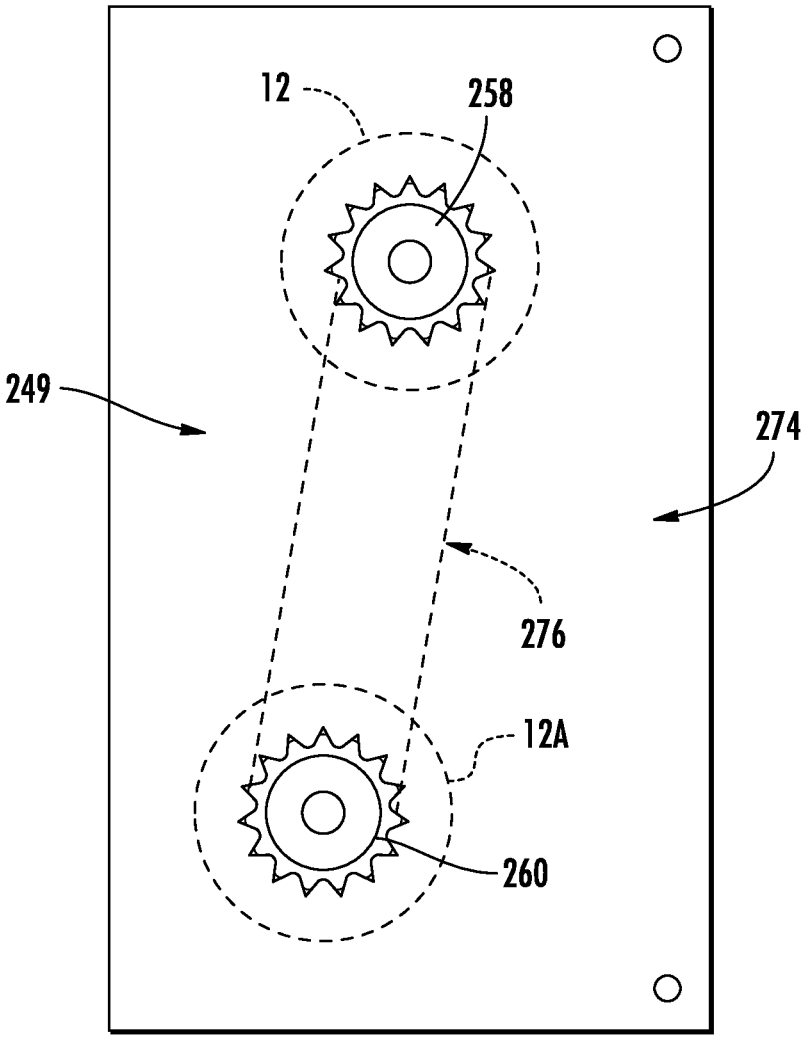
FIG. 16 is a side view showing the synchronizing sprocket and chain assembly that synchronizes the rotation of the two barrels of the balancing strip collector of the present invention.

As shown in the elevational view of FIG. 13 and the detailed end view of FIG. 16, the connection 249, in the sprocket and chain configuration, includes a curtain coil connecting sprocket 258, coupled to one end of the curtain coil barrel 12, balancing strips connecting sprocket 260, coupled to a corresponding end of the balancing strip collector barrel 12A, and a connecting chain 276, which connects and synchronizes the rotation of, the barrels 12 and 12A. As can be seen in FIG. 13, the curtain coil barrel 12 is coupled to the curtain coil connecting sprocket 258 by a shaft 120, while the balancing strip collector barrel 12A is coupled to the balancing strips connecting sprocket 260 by a shaft 120A. As discussed above, a pulley and belt configuration may be employed in place of the sprocket and chain configuration. In such a case, the sprockets would be replaced by corresponding pulleys, while the chain would be replaced by a belt.

While the synchronization supplied by the connection 249 provides for a general synchronization between the rolling up of the curtain 20 and the balancing strips 230, the inventors have found that, in use, some slack may occur in the portion of the balancing strips 230 that traverses the barrels 12 and 12A during both deployment and retraction of the curtain 20. Such slack can result in irregular rolling up of the balancing strips 230. To compensate for, or prevent, any slack that may occur, a constant tensioning spring assembly 262, shown in FIG. 13, is provided with the balancing strip collector barrel 12A. The purpose of the constant tensioning spring assembly 262 is to provide a spring bias for the balancing strip collector barrel 12A in a direction opposite the take up direction of the curtain and the balancing strips. This biasing provides a pull on the balancing strip portion traversing the gap between the barrels 12 and 12A, the pull preventing the occurrence of any slack in the portion between the two barrels. The biasing force is adjusted to be enough to prevent slack, but less than the force provided by the motor 241, to still allow the motor 241 to be able to rotate both of the barrels 12 and 12A.

By virtue of the invention, a curtain 20 can be rolled upon on the curtain coil roller 12 without the occurrence of bulges in the locations corresponding to the overlapping portions 26.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice.

What is claimed is:

1. A door assembly positionable about a structure opening in a structure wall, the door assembly comprising:

a rotatable curtain deployment member having a longitudinal axis and positionable about the structure opening;

a curtain panel having a first end fixed to the curtain deployment member, and a free end, the free end being movable in a moveable direction, upon rotation of the curtain deployment member, between a retracted position where the structure opening is at least partially uncovered, and an extended position where the curtain panel covers at least a portion of the structure opening, the curtain panel having at least one portion of increased thickness aligned with a location on the curtain deployment member, the at least one portion of increased thickness extending in the moveable direction over at least a portion of the curtain panel;

a rotatable balancing strip member having a longitudinal axis and a length, at least a portion of the length being longitudinally coextensive with the curtain deployment member, the balancing strip member configured to be mounted about the structure opening in a substantially parallel arrangement with the curtain deployment member, the balancing strip member being engaged with the curtain deployment member so as to rotate synchronously, with the curtain deployment member, and a balancing strip having a first end attached to the balancing strip member, and a second end attached to the curtain deployment member, the balancing strip having an axial width that is less than the axial width of the curtain panel, and being axially spaced from the at least one portion of increased thickness, wherein upon synchronous movement of the balancing strip member and curtain deployment member in a direction to deploy the curtain panel into the retracted position, at least a portion of the balancing strip deploys from the balancing strip member to the curtain deployment member, and wherein upon synchronous movement of the balancing strip member and curtain deployment member to deploy the curtain panel to the extended position, the portion of the balancing strip deploys from the curtain deployment member to the balancing strip member.

2. The door assembly according to claim 1, wherein a thickness of the balancing strip when rolled up on the curtain deployment member is set to correspond to a thickness of the portion of increased thickness of the curtain panel when the curtain panel is rolled up on the curtain deployment member.

3. The door assembly according to claim 1, wherein the balancing strip ends are positioned at an aligned location on the curtain deployment member and the balancing strip member.

4. The door assembly according to claim 1, wherein:

the at least one portion of increased thickness of the curtain panel extends in the moveable direction over a portion of the curtain panel less than the entire length of the curtain deployment member in the moveable direction, and a thickness of the balancing strip is configured so as to have a thickness that approximates the thickness of the at least one portion of increased thickness of the curtain panel only over a portion of the length of the balancing strip that corresponds with the at least one portion of increased thickness of the curtain deployment member.

5. The door assembly according to claim 1, wherein the curtain panel is flexible, establishes a fire barrier across the structure opening in the extended position, and comprises at least one selected from the group consisting of:

a fire resistant textile material, a fire resistant textile composite material, and a fire resistant metallic material.

6. The door assembly according to claim 1, further comprising a sprocket and chain, or pulley and belt, connection formed between the balancing strip member and the curtain deployment member, the connection providing synchronization of rotational movement, in a common rotational direction, between the rotatable balancing strip member and the curtain deployment member.

7. The door assembly according to claim 1, wherein the rotatable balancing strip member comprises:

a constant tensioning spring assembly, the constant tensioning spring assembly being configured to provide a spring bias for the rotatable balancing strip member in a direction opposite a take up direction of the curtain panel and the balancing strip, so as to provide a pull on the balancing strip portion traversing a gap between the rotatable curtain deployment member and the rotatable balancing strip member, the pull preventing the occurrence of slack in the portion of the balancing strip between the rotatable curtain deployment member and the rotatable balancing strip member.

8. The door assembly according to claim 1, further comprising a motor configured to directly drive the rotatable curtain deployment member to wind the curtain panel and the balancing strips onto the rotatable curtain deployment member.

9. The door assembly according to claim 1, wherein the at least one portion of increased thickness comprises at least one overlapping portion of the curtain panel.

10. The door assembly according to claim 9, wherein a location of the balancing strip in the longitudinal direction is at a location that does not longitudinally overlap with the at least one overlapping portion, so that the balancing strip is located longitudinally separated from each at least one overlapping portion so that the curtain panel is evenly suspended over the at least one overlapping portion and the balancing strip.

11. The door assembly according to claim 1, wherein in the extended position of the curtain panel, each at least one balancing strip is completely wound around the rotatable balancing strip member except for a connecting portion of the balancing strip which extends to, and connects with, the rotatable curtain deployment member.

12. The door assembly according to claim 11, wherein the connection of the connecting portion of the balancing strip to the rotatable curtain deployment member occurs at an affixing location on the rotatable curtain deployment member.

13. The door assembly according to claim 12, wherein the connection of the connecting portion of the balancing strip to the rotatable curtain deployment member is implemented by at least one selected from the group consisting of: an adhesive, a connection with a slot formed in the rotatable curtain deployment member, staples, and non-staple fasteners.

14. The door assembly according to claim 12, wherein the connecting portion of the balancing strip is attached, at the affixing location, at a side of the rotatable curtain deployment member from which the curtain panel hangs, and to which the curtain panel, when being rolled up, will travel such that, when the rotatable curtain deployment member turns so as to retract the curtain panel onto the rotatable curtain deployment member, the same turning of the rotatable curtain deployment member will, for each instance of the balancing strip, cause a taking up initially of the connecting portion of the balancing strip, and subsequently the remainder of the balancing strip, onto the rotatable curtain deployment member.

* * * * *